United States Patent [19]

Seader et al.

[11] 4,160,720

[45] Jul. 10, 1979

[54] PROCESS AND APPARATUS TO PRODUCE SYNTHETIC CRUDE OIL FROM TAR SANDS

[75] Inventors: Junior D. Seader; Kirshnakumar M. Jayakar, both of Salt Lake City, Utah

[73] Assignee: University of Utah, Salt Lake City, Utah

[21] Appl. No.: 851,226

[22] Filed: Dec. 15, 1977

[51] Int. Cl.[2] ..... C10G 1/00; C10B 49/10; C10B 49/00

[52] U.S. Cl. ..... 208/11 R; 201/31; 202/120

[58] Field of Search ..... 208/11 R; 201/31; 202/120

[56] References Cited

U.S. PATENT DOCUMENTS

| | | | |
|---|---|---|---|
| 2,471,119 | 5/1949 | Peck et al. | 208/11 R X |
| 2,579,398 | 12/1951 | Roetheli | 208/11 R X |
| 2,647,077 | 7/1953 | Alleman | 208/11 R X |
| 2,908,617 | 10/1959 | Murphree | 208/11 R X |
| 3,839,186 | 10/1974 | Berger | 201/31 X |
| 3,867,110 | 2/1975 | Schora et al. | 201/31 X |

FOREIGN PATENT DOCUMENTS 530920 9/1956 Canada.

*Primary Examiner*—Delbert E. Gantz
*Assistant Examiner*—William G. Wright

[57] ABSTRACT

A process and apparatus for producing synthetic crude oil from bitumen-bearing sands. The apparatus includes a vessel segregated into a pyrolysis zone and a combustion zone, each zone being in the form of a fluidized bed reactor. At least one heat pipe is provided for transferring thermal energy from the combustion zone to the pyrolysis zone where the thermal energy is used to pyrolyze the bitumen. The apparatus may also include additional heat exchange equipment for heating the incoming combustion air for the combustion zone. The combustion air serves as the fluidizing medium for the fluidized bed reactor of the combustion zone while flue gases from the combustion zone serve as the fluidizing medium for the fluidized bed reactor of the pyrolysis zone.

19 Claims, 2 Drawing Figures

PROCESS AND APPARATUS TO PRODUCE SYNTHETIC CRUDE OIL FROM TAR SANDS

BACKGROUND

1. Field of the Invention

This invention relates to a process and apparatus for recovering bitumen from bitumen-bearing sands and, more particularly, to a thermal process for producing synthetic crude oil, the process being particularly characterized by the absence of water or solvents in the recovery process.

2. The Prior Art

The term "tar sand" is used to refer to a consolidated mixture of bitumen (tar) and sand. Tar sand is also referred to as oil-impregnated sandstone, oil sand, and bituminous sand, among others. The latter term is generally considered to be more technically correct in that the sense of the term provides an adequate description of the mixture. The sand in tar sand is mostly alpha quartz as determined from x-ray diffraction patterns, while the bitumen or tar consists of a mixture of a variety of hydrocarbons and substituted hydrocarbons. Importantly, if properly separated from the sand component, bitumen may be used as a synthetic crude oil feed stock for the production of synthetic fuels and/or petrochemicals.

Tar sand deposits occur throughout the world, often in the same geographical areas as petroleum deposits. Significantly large, surface-available tar sand deposits have been identified and mapped in Canada, Venezuela, and the United States. The major Canadian tar sand deposit is known as the Athabasca deposit and is located in the province of Alberta, Canada. Analysis of Athabasca Tar Sand indicates an average bitumen content of approximately 12–13 percent, by weight, and a reserve estimated to be the equivalent of approximately 700 billion barrels of bitumen. To date, the Athabasca Tar Sand deposit is the only tar sand deposit in the world that is currently being commercially mined and processed for the recovery of bitumen.

A significant portion of the tar sand deposits discovered to date in the United States have been found in the State of Utah. According to a report by the Utah Geological and Mineral Survey, the State of Utah contains at least 25 billion barrels of bitumen in the form of Utah tar sands. This represents approximately 95 percent of the total mapped tar sand reserves of the United States. Although the Utah tar sand reserves appear small in comparison with the enormous potential of the Canadian tar sands, the Utah tar sand reserves represent a significant energy resource when compared to the United States crude oil proven reserves (approximately 31.3 billion barrels) and the United States crude oil production of almost 3.0 billion barrels during 1976.

Utah tar sands generally occur in six major deposits along the eastern edge of the state, and the bitumen content varies from deposit to deposit as well as within a given deposit. However, the current information available indicates that the Utah tar sand deposits average generally less than 10 percent bitumen, by weight, but have been found with a bitumen content up to 17 percent, by weight.

Typically, bitumen obtained from bitumen-bearing tar sand consists of high molecular weight molecules. These molecules are generally hydrocarbons and substituted hydrocarbons containing some nitrogen, oxygen, sulphur, etc. The bitumen recovered directly from tar sand is quite viscous. Tests have determined that bitumen from Utah tar sands is two orders of magnitude of about 100 times more viscous than bitumen obtained from Athabasca Tar Sand.

Currently, the only large-scale commercial process for the recovery of bitumen from tar sands involves Athabasca Tar Sand and utilizes a hot-water extraction technique which is conducted at temperatures just below the normal boiling point of water with substantially no change in the chemical nature of the recovered bitumen. However, this particular hot-water extraction technique is restricted to tar sands containing more than about 10 percent bitumen, by weight.

Importantly, Athabasca Tar Sand also has a relatively high moisture content of approximately 3–5 percent, by weight, connate water. It has, therefore, been postulated by certain investigators that the equilibrium structure of Athabasca Tar Sand consists of sand particles mixed with but separated from the bitumen matrix by a film of connate water. The connate water surrounds each grain of sand thereby separating the bitumen from the sand grains. Under these conditions, Athabasca Tar Sand is readily amenable to a hot-water separation technique whereby the bitumen phase is simply disengaged from the sand phase.

A more comprehensive discussion of Athabasca Tar Sand may be found in the literature including, for example, (1) E. D. Innes and J. V. D. Fear, "Canada's First Commercial Tar Sand Development," *Proceedings of the Seventh World Petroleum Congress,* Elsevier Publishing Co., 3, p. 633, (1967); (2) F. W. Camp, *The Tar Sands of Alberta Canada,* 2nd Edition, Cameron Engineering, Inc., Denver, Colo. (1974); and (3) J. Leja and C. W. Bowman, "Application of Thermodynamics to the Athabasca Tar Sands," *Canadian Journal of Chemical Engineering,* 46, p, 479 (1968).

Additionally, the following U.S. patents are a few of the patents that have been granted for apparatus or processes useful for obtaining bitumen for tar sands and, in some cases, specifically Athabasca Tar Sand: U.S. Pat. Nos. 1,497,607; 1,514,113; 2,871,180; 2,965,557; 3,161,581; 3,392,105; 3,553,099; 3,560,371; 3,556,980; 3,605,975; 3,784,464; 3,847,789; 3,875,046; and 3,893,907. Each of the foregoing patents deals with either the solvent or hot-water extraction of bitumen from tar sand.

Unlike Athabasca Tar Sand, Utah tar sands have been found to be so dry that no moisture content can be detected by standard analytical techniques. Accordingly, in the absence of connate water, the bitumen of Utah tar sands is directly in contact with and bonded to the surface of the sand grains. Attempts have been made to process Utah tar sands with the hot-water processes used for Athabasca Tar Sand. However, these attempts have generally proved to be unsuccessful. Additionally, it is well known that the Utah tar sand deposits occur in a region which is particularly characterized by the scarcity of excess water so that any process attempting to utilize Utah tar sands, in the absence of a special technique for dislodging the bitumen from the tar sands, should be directed to a process which requires very little, if any, water.

Canadian Pat. No. 530,920 discloses a process for recovering bituminous products from tar sands wherein tar sand containing water and chemically unaltered bitumen are introduced into a fluidized bed reactor. The bituminous matrix is partially cracked to hydrocarbon compounds having relatively short chain molecules and released from the sand particles leaving a coke residue. The coke residue is burned in a separate furnace to heat the sand residue. The heated sand is returned to the fluidized bed reactor where it supplies the required thermal energy to raise the temperature of the raw material in the fluidized reaction bed. It is, therefore, obvious that this type of thermal energy transfer through the use of recycled sand requires extensive materials handling. Additional heat may be supplied by burning a portion of the liberated gas such as hydrogen, methane, and the like in the fluidized bed.

The foregoing materials handling problem is particularly relevant in view of the substantial quantities of materials expected to be handled. For example, a process handling 5,000 pounds per minute of tar sand containing 14 percent bitumen and 1 percent water requires recycling about 12,750 pounds of hot, burnt sand per minute from the furnace to the reaction chamber to maintain the reaction temperature, see column 6, lines 26–29. It would, therefore, be an advancement in the art to provide an improved apparatus and process for recovering bituminous products from tar sands wherein (1) material handling is reduced to a minimum, (2) the solids pass through the reaction vessel in a single pass and are assisted by gravity in passage, and (3) thermal energy is transferred by heat pipes between fluidized bed reactors. Such an invention is disclosed and claimed herein.

BRIEF SUMMARY AND OBJECTS OF THE INVENTION

The present invention relates to an apparatus and process whereby comminuted tar sands are introduced into a first, fluidized bed, which serves as a pyrolysis zone to thermally crack the bituminous hydrocarbons and substituted hydrocarbons in the tar sand. The cracked, bituminous hydrocarbons and substituted hydrocarbons are volatilized leaving a carbonaceous or coke residue on the sand grains. The coked sand is introduced into a second fluidized bed where the coke is burned in air to produce thermal energy and flue gases. The thermal energy is transmitted into the first, fluidized bed, to a minor degree, by the flue gases but, primarily, by heat transfer apparatus extending between the two. The flue gases primarily serve as the fluidizing medium for the first, fluidized bed while incoming combustion air provides the necessary fluidizing medium for the coked sand in the second, fluidized bed. Advantageously, the first, fluidized bed may be positioned over the second, fluidized bed in a generally vertically oriented vessel so that the solids pass downwardly through the apparatus under the action of gravity while the gases flow countercurrently in an upward direction and fluidize both beds while carrying away the resultant bituminous product. Additionally, the vertical orientation of the apparatus readily accommodates the use of heat pipes as the heat transfer apparatus to transfer a major portion of the thermal energy from the lower, combustion zone to the upper, pyrolysis zone.

It is, therefore, a primary object of this invention to provide an improved process for producing synthetic crude oil from bitumen-bearing tar sands.

Another object of this invention is to provide an improved apparatus for producing synthetic crude oil from bitumen-bearing tar sands.

Another object of this invention is to provide an apparatus for recovering bitumen from bitumen-bearing tar sands wherein thermal energy is transferred from a combustion zone to a reaction zone by a heat pipe apparatus.

Another object of this invention is to provide an improved apparatus for extracting bitumen from bitumen-bearing tar sands wherein the process is substantially self-sustaining in its energy requirements since substantially all of the required energy for the process is obtained by burning a coke residue remaining after the cracked bitumen has been removed from the tar sands.

These and other objects and features of the present invention will become more fully apparent from the following description and appended claims taken in conjunction with the accompanying drawing.

BRIEF DESCRIPTION OF THE PREFERRED EMBODIMENTS

Figure 1:
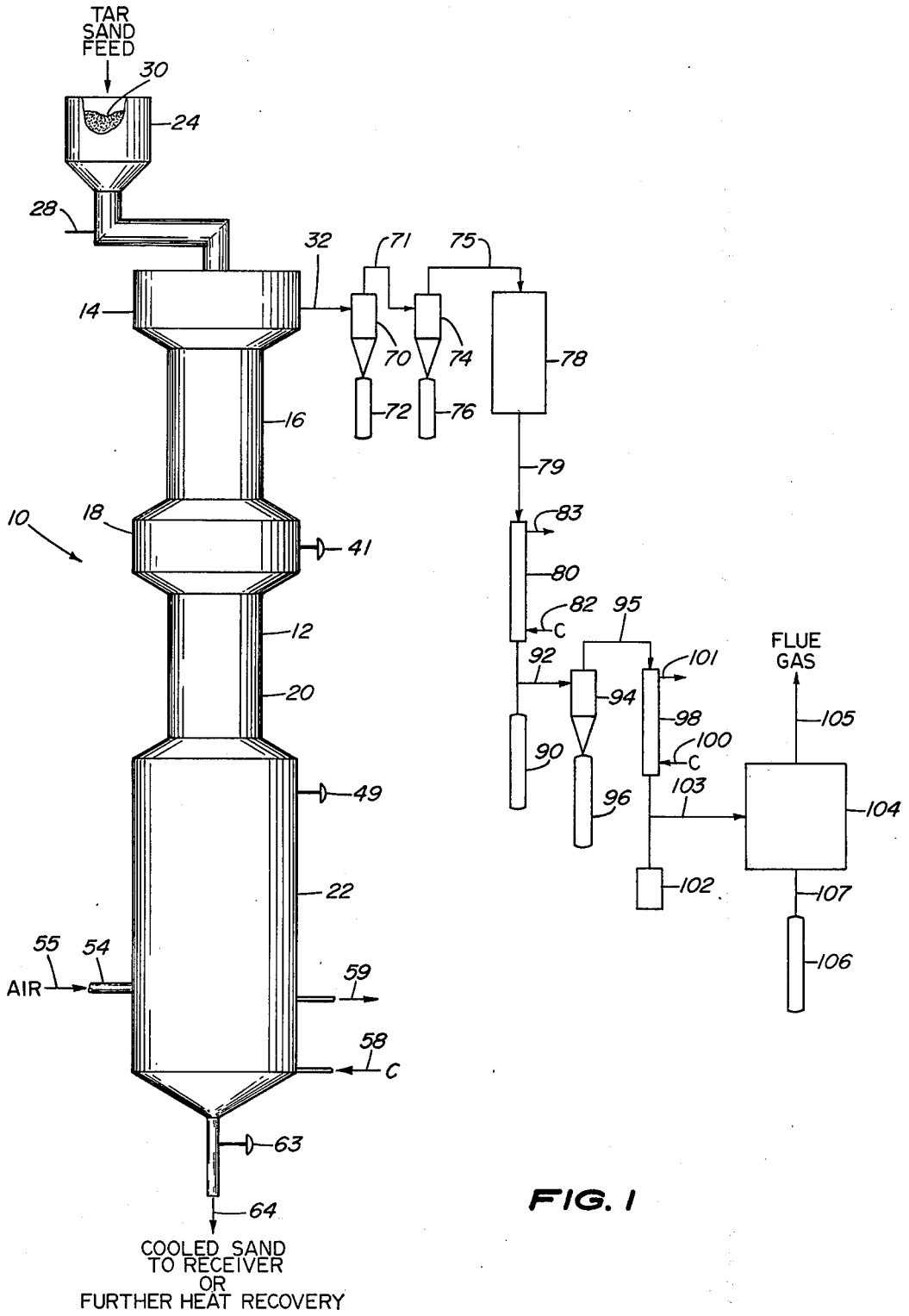
FIG. 1 is an overall flow diagram of the process of the present invention.

The invention is best understood by reference to the drawing wherein like parts are designated with like numerals throughout.

GENERAL DISCUSSION

Typically, bitumen consists of high molecular weight molecules which are hydrocarbons and substituted hydrocarbons containing some nitrogen, oxygen, and sulphur, among others. When subjected to high temperatures at ambient pressure and in the absence of oxidizing species, the bitumen is cracked to lower molecular weight compounds that are readily volatilized at the temperatures involved. In the absence of reducing species, a solid carbonaceous residue called coke is left behind as a deposit on the sand particles. The coke, upon combustion, can provide substantially all of the energy required by the foregoing cracking step. Where necessary, supplemental thermal energy can be supplied to the combustion zone by introducing additional quantities of a suitable fuel such as asphaltenes, powdered coal, petroleum coke, or the like.

Importantly, the process of this invention can be used to process tar sand of virtually any bitumen content and avoids (1) the use of water, (2) handling of very viscous bitumen, (3) recycling of process streams, and (4) formation of wastes that might create environmental difficulties. Instead, the process produces lower molecular weight hydrocarbons and substituted hydrocarbons useful as a synthetic crude oil and dry, clean sand. Energy for the process is derived in an efficient manner from a small percentage of the bitumen itself. The process is adapted to the continuous treatment of tar sands and, except for initial start-up requirements, the process is essentially self-sufficient with respect to energy requirements.

DETAILED DESCRIPTION OF THE PREFERRED EMBODIMENTS

Figure 2:
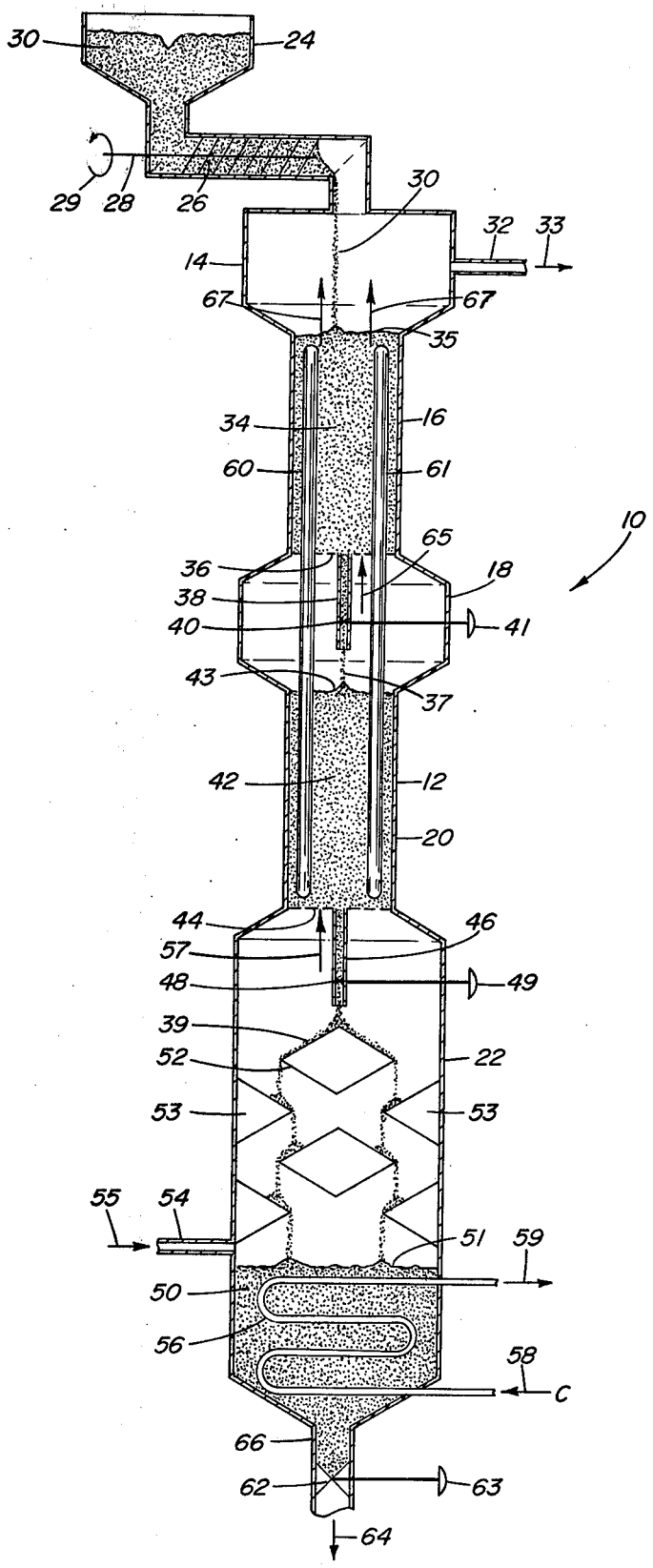
FIG. 2 is an enlarged, schematic, cross-sectional view of the reactor apparatus of FIG. 1.

Referring now to FIGS. 1 and 2, the equipment depicted therein is patterned after laboratory equipment used to demonstrate the invention wherein the reactor of this invention is shown generally at 10 and is fabricated as a vertically oriented vessel 12. Vessel 12 is segregated downwardly into an upper separation zone 14, a pyrolysis zone 16, a middle separation zone 18, a combustion zone 20, and an air preheating zone 22. The function of each of these zones will be discussed in more detail hereinafter. Importantly, in the preferred embodiment of this invention, vessel 12 is cylindrical and is particularly adapted to be oriented vertically so as to accommodate the downward movement of solids through the vessel under the action of gravity. Vertical orientation of vessel 12 is also advantageous in that it readily accommodates the use of heat pipes 60 and 61 as will be discussed more fully hereinafter.

Tar sand, indicated schematically herein as tar sand 30, is introduced into the vessel 12 from a hopper 24 by means of a conventional feeder such as a screw apparatus 26 mounted upon a shaft 28. Rotation of shaft 28, as indicated schematically by rotation arrow 29, withdraws tar sand 30 from hopper 24 depositing the same at a predetermined and selectively controllable rate in vessel 12. Screw apparatus 26 is filled with tar sand 30 and thereby also serves as a valving mechanism by preventing hot gases from leaving vessel 12 through hopper 24. To avoid plugging of screw apparatus 26 by tar sand 30, both should be maintained at ambient temperature until tar sand 30 drops into upper separation zone 14. Contact between tar sand 30 as it exits from screw apparatus 26 and the hot gases can also be reduced by introducing an inert gas into vessel 12 at the discharge end of screw apparatus 26. This inert gas could also be provided by recycling a portion of the flue gases exhausted through outlet 105, as appropriate.

Tar sand 30 enters fluidized bed 34 of pyrolysis zone 16 where, at temperatures from about 350° C. to 550° C., 75 to 85 percent of the bitumen therein is converted to volatile products that commingle with flue gases 65 and are carried out of the top of fluidized bed 34 as product 67. Product 67 is removed from vessel 12 through outlet 32 as a product/flue stream 33. The residual 15 to 25 percent of the bitumen remains as a coke residue on the sand particles to form coked sand 37.

The lower end of fluidized reaction bed 34 is supported by a distributor plate 36 which allows flue gases 65 from combustion zone 20 to pass upwardly into fluidized reaction bed 34 thereby maintaining its fluidized state. The amount of coked sand 37 discharged from fluidized reaction bed 34 downwardly through a sand outlet 38 and thereby the upper level 35 of fluidized reaction bed 34 is suitably controlled by regulation of a valve 40 through a regulator 41.

Coked sand 37 from fluidized reaction bed 34 enters combustion zone 20 where it becomes a part of fluidized combustion bed 42. The coke is burned between about 500° C. and 700° C. by the oxygen in the fluidizing, heated combustion air 57 to produce thermal energy, hot combustion flue gas 65 and a hot, burnt sand 39.

The lower end of fluidized combustion bed 42 is supported by a distributor plate 44 which permits the upward passage of heated combustion air 57 to maintain the fluidized state of fluidized combustion bed 42. The upper level 43 of fluidized combustion bed 42 is maintained by suitably controlling the discharge of burnt sand 39 from sand outlet 46 by regulation of a valve 48 through a regulator 49. Significantly, enough of a pressure drop is realized along the length of sand outlets 38 and 46 to preclude the upward passage of flue gases 65 and combustion air 57, respectively, therethrough, thereby forcing flue gases 65 and combustion air 57 to pass upwardly through distributor plates 36 and 44, respectively.

Cold combustion air 55 is introduced into reactor vessel 10 through an air inlet 54. Advantageously, combustion air 55 is heated in air preheating zone 22 to about 450° C. to 650° C. by downwardly falling burnt sand 39 to provide heated combustion air 57. After being slightly cooled by the incoming, cold, combustion air 55, the still warm sand collects at the bottom of the air preheating zone 22 as sand residue 50 and has a temperature from about 350° C. to 550° C. Residual thermal energy in sand 50 can be further removed by heating an incoming stream 58 in heat exchange coils 56 to provide a heated stream 59. The upper level 51 of sand 50 is maintained by discharging cooled sand 64 through a sand outlet 66 regulated by a valve 62 in conjunction with a regulator 63.

Heat exchange between the burnt sand 39 and cold combustion air 55 can be enhanced by a plurality of baffles 52 and 53 which form a cascade over which burnt sand 39 tumbles downwardly. Burnt sand 39 may be alternately dispersed and concentrated by baffles 52 and 53, respectively. Accordingly, the air preheating zone 22 acts as a counter-current flow type heat exchanger for the upwardly passing, cold, combustion air 55 and downwardly falling burnt sand 39. Alternatively, sand outlet 46 could be interconnected directly to sand outlet 66 as a continuous pipe (not shown) and the pipe provided with a plurality of fins (not shown) or the like for the purpose of accommodating the appropriate heat exchange relationship between burnt sand 39 and incoming combustion air 55.

It should be particularly noted that the upper separation zone 14 and the mid-separation zone 18 are each provided with a diametrally-enlarged section. The enlarged diameter of each of the foregoing separation zones provides an enlarged cross-sectional area for the upwardly passing gases thereby significantly lowering the velocity of the same. Accordingly, a substantial portion of the entrained solids, which would otherwise tend to be carried along with the upwardly passing gas, is allowed to settle out thereby forming the respective upper layer of each of the fluidized reaction bed 34 and fluidized combustion bed 42.

A plurality of heat pipes, shown herein as heat pipes 60 and 61, have one end immersed in the fluidized combustion bed 42 and the upper end immersed in fluidized reaction bed 34 to thereby transfer thermal energy from fluidized combustion bed 42 to fluidized reaction bed 34. Heat pipes 60 and 61 are conventional apparatus and are partially filled with a suitable working fluid such as sodium, potassium, or cesium, metals which have a suitable, low melting point. Heat liberated in the fluidized combustion bed 42 vaporizes the working fluid in heat pipes 60 and 61 and the working fluid vapor rises to the upper end of heat pipes 60 and 61 where the heat of vaporization is released in fluidized reaction bed 34. The internal walls of heat pipes 60 and 61 are lined with wicks for the working fluid so that condensed working fluid at the upper end flows downwardly through the wicks to the lower end of the heat pipes 60 and 61 as a liquid to repeat the evaporation-condensation cycle.

Importantly, heat pipes 60 and 61 accommodate a single pass flow-through of solids through the reactor vessel 10 thereby eliminating the requirement that hot sand from combustion zone 20 be recycled into pyrolysis zone 16. The single pass system commences with cold tar sands 30 from hopper 24 being introduced into fluidized reaction bed 34 where approximately 75 to 85 percent of the bitumen is cracked at temperatures between about 350° C. and 550° C. to form hydrocarbon and substituted hydrocarbon vapors which commingle with flue gases to give product gases 67. Coked sand 37 from fluidized reaction bed 34 is directed into fluidized combustion bed 42 wherein most of the coke residue representing the remaining 15 to 25 percent residual bitumen is burned at temperatures between 500° C. and 700° C. The resulting combustion gas 65 rises upwardly to fluidize the fluidized reaction bed 34 leaving a residue of hot, clean burnt sand 39. Oxygen in heated combustion air 57 is almost completely consumed in fluidized combustion bed 42 to avoid undesirable oxidation of bitumen in fluidized reaction bed 34. The rising hot combustion gases, flue gases 65, from fluidized combustion bed 42 maintain the fluidized state of fluidized reaction bed 34 while being cooled from about 500° C. to 700° C. to about 350° C. to 550° C. Flue gases also transfer approximately 5 to 15 percent of the thermal energy required in pyrolysis zone 16. The remainder of the thermal energy requirement for pyrolysis zone 16 is transferred by heat pipes 60 and 61 as set forth hereinbefore. Advantageously, heat pipes 60 and 61 provide the necessary heat transfer capability to prevent excessively high temperatures in combustion zone 20 and thereby preclude equipment failure from the excessive temperatures developed. However, supplemental thermal energy for pyrolysis zone 16 can be provided by introducing additional air into combustion zone 20. Upon entering pyrolysis zone 16, the resulting unreacted oxygen undergoes further combustion.

Referring now more particularly to FIG. 1, sand fines that are not removed from the product gases 67 in the upper separation zone 14 are removed in cyclone separators 70 and 74 and collected in receivers 72 and 76. Alternatively, other apparatus for fines removal may be employed, for example, a cyclone separator (not shown) that could be located in separation zone 14. Vapor is directed from the first stage cyclone separator 70 as a product 71 and from the second stage cyclone separator 74 as product 75 which is filtered in a sintered metal filter 78 for final removal of sand fines. Sintered metal filter 78 can be suitably coupled with a spare to accommodate periodic clean-out. The resulting vapor from filter 78 contains water vapor from the combustion process in fluidized combustion bed 42. This water vapor is condensed along with some of the bitumen vapor in cooler 80. Condensate from cooler 80 is collected in condensate receiver 90.

Vapor 92 is then introduced into another cyclone separator 94 with condensate collecting in condensate receiver 96. Additional condensation is accomplished in cooler 98 with condensate being collected in condensate receiver 102. Final removal of any oil mist in vapor 103 occurs in an electrostatic precipitator 104 which delivers condensate 107 collected therefrom to a condensate receiver 106. The residual gas is exhausted to the atmosphere or directed to a scrubbing or purification system (not shown) through exhaust line 105. Additionally, part of the residual gas may be recycled into vessel 12 as a technique for protecting tar sand 30 from the hot gases produced in pyrolysis zone 16 as set forth hereinbefore.

Coolant streams (C) 82, 100, and 58 for coolers 80 and 98 and heat exchanger 56, respectively, may be air, water or provided from any suitable source and may be recycled, if desired, from warm streams 83, 101, and 59, respectively, after being suitably cooled to the desired temperature.

Importantly, in the operation of the apparatus of this invention, the quantity of oxygen in combustion air 55 corresponds approximately to the stoichiometric quantity of oxygen required for combustion of the coke in fluidized combustion bed 42. The combustion gases leaving fluidized combustion bed 42 and entering fluidized reaction bed 34 contain essentially no oxygen unless required for providing supplemental thermal energy as set forth hereinbefore. Accordingly, the operating variables in the process of this invention are (1) the feed rate of tar sand 30 from hopper 24, (2) the volume of combustion air 55, and (3) the operating temperatures of fluidized reaction bed 34 and fluidized combustion bed 42. These variables are selectively adjusted according to the bitumen content of the tar sand and the coke-forming characteristics of the bitumen.

In one example, calculated for a daily operating basis, 10 megakilograms of tar sand consisting of 8.6 megakilograms sand and 1.4 megakilograms bitumen or 14 percent bitumen are fed into fluidized pyrolysis bed 34 where the bitumen is suitably pyrolyzed at 450° C. Coked sand 37 consisting of 8.6 megakilograms sand and 0.225 megakilograms coke or carbon is then directed into fluidized combustion bed 42 where the coke is burned at 600° C. The resulting burnt sand 39 consists of 8.6 megakilograms sand and 0.015 megakilograms unburned coke.

Cold combustion air 55 consisting of 1.87 megakilograms nitrogen and 0.56 megakilograms oxygen is fed into the preheater apparatus of air preheater 22 where it is heated to 540° C. while burnt sand 39 is cooled to 440° C. and deposited as sand residue 50. After combustion in fluidized combustion bed 42, the upwardly-directed gas, now flue gas 65, consists of 1.87 megakilograms nitrogen and 0.77 megakilograms carbon dioxide having a temperature of 600° C. Flue gas 65 is passed upwardly through and fluidizes the fluidized reaction bed 34 and combines with the volatilized bitumen vapors to form product stream 67 consisting of 1.175 megakilograms cracked bitumen.

In a second example, 10 megakilograms tar sand containing 8 percent bitumen are processed. In this case, 0.20 megakilograms coke are burned in fluidized combustion bed 42 with 2.26 megakilograms air. This process produces 0.60 megakilograms cracked bitumen.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes that come within the meaning and range of equivalency of the claims are therefore to be embraced therein.

What is claimed and desired to be secured by United States Letters Patent is:

1. An apparatus for processing bitumen-bearing tar sands for the recovery of bitumen therefrom comprising:

means for maintaining a first fluidized bed for the bitumen-bearing tar sands, the first fluidized bed serving as a pyrolysis zone for bitumen of the bitumen-bearing tar sands, the pyrolysis zone cracking a substantial portion of the bitumen and thereby volatilizing the same while leaving a carbon residue in the form of coke on the tar sands;

means for introducing a comminuted, bitumen-bearing tar sand into the first fluidized bed;

means for introducing coked tar sands from the first fluidized bed into a second fluidized bed;

means for maintaining the second fluidized bed for the coked tar sands from the first fluidized bed, the second fluidized bed serving as a combustion zone for the coke on the coked tar sands to thereby develop thermal energy in the second fluidized bed; and heat transfer means comprising heat pipe means for conducting the thermal energy from the second fluidized bed to the first fluidized bed.

2. The apparatus defined in claim 1 wherein the first fluidized bed and the second fluidized bed are contained within a single, vertically-oriented vessel to accommodate gravity-assisted movement of solids through the vessel.

3. The apparatus defined in claim 2 wherein the second fluidized bed is below the first fluidized bed, the apparatus further comprising valve means below the first fluidized bed to thereby accommodate controlling the rate at which coked tar sand is introduced into the second fluidized bed from the first fluidized bed.

4. The apparatus defined in claim 1 wherein the fluidized beds are maintained in the fluidized state by combustion air in the second fluidized bed, the combustion air supporting combustion of the carbon on the coked tar sands, the combustion products from said combustion process maintaining the fluidized state of the first fluidized bed.

5. The apparatus defined in claim 4 wherein means are provided for heating the incoming air into the second combustion zone, said means providing heat exchange between sand from the second fluidized bed and the incoming air, thereby heating the incoming air.

6. An apparatus for processing bitumen-bearing tar sands comprising:

a vessel;

a first distributor plate in the vessel, the distributor plate defining a pyrolysis zone for bitumen-bearing tar sand;

means for introducing comminuted tar sand into the pyrolysis zone;

a second distributor plate in the vessel, the distributor plate defining a combustion zone for coked tar sand obtained from the pyrolysis zone;

delivery means for delivering coked tar sand from the pyrolysis zone to the combustion zone;

air inlet means for introducing air into the combustion zone, the air supporting combustion of coke on the coked tar sands to produce thermal energy;

heat transfer means comprising heat pipe means, a first end of the heat pipe means being embedded in the combustion zone and a second end of the heat pipe means being embedded in the pyrolysis zone for conducting thermal energy from the combustion zone to the pyrolysis zone in the vessel; and removal means for removing burnt sand from the combustion zone.

7. The apparatus claimed in claim 6 wherein the vessel includes a diametrally enlarged area above each of the pyrolysis zone and the combustion zone, the diametrally enlarged area serving as an expansion means for lowering upward gaseous velocity in the vessel thereby reducing the quantity of solids entrained in the upwardly-flowing gaseous stream.

8. The apparatus defined in claim 6 wherein the vessel further includes heat exchange means for heating incoming combustion air by absorbing heat from burnt sand from the combustion zone.

9. The apparatus defined in claim 6 wherein the vessel is vertically oriented with the pyrolysis zone above the combustion zone to thereby accommodate gravity-assisted delivery of coked tar sand from the pyrolysis zone to the combustion zone.

10. An apparatus for processing tar sands comprising:

a vertically oriented vessel;

a pyrolysis zone in the vessel adjacent the upper end of the vessel;

a combustion zone in the vessel below and spaced from the pyrolysis zone;

inlet means for introducing comminuted tar sands into the pyrolysis zone, the tar sand being pyrolyzed to release bitumen from the tar sands while forming coked sand by leaving a coke residue on the sand;

delivery means for depositing the coked sand from the pyrolysis zone into the combustion zone to accommodate the coke being burned therein to form thermal energy;

heat transfer means between the combustion zone and the pyrolysis zone to transfer that portion of the thermal energy not contained in gases leaving the combustion zone to the pyrolysis zone said heat transfer means comprising a heat pipe means, a first end of the heat pipe means in thermal contact with the combustion zone and a second end of the heat pipe means in thermal contact with the pyrolysis zone; and settling zones above each of the pyrolysis zone and the combustion zone, each settling zone comprising a diametral enlargement of the vessel, the diametral enlargement reducing the velocity of upwardly flowing gases thereby allowing suspended particulate materials to settle from the gases.

11. The apparatus defined in claim 10 wherein the vessel further includes air delivery means for introducing air into the vessel below the combustion zone, the air supplying oxygen for combustion of the coke while accommodating formation of a fluidized bed in the combustion zone, the combustion process producing burnt sand and flue gases.

12. The apparatus defined in claim 11 wherein the air delivery means further comprises heat exchange means for transferring heat from the burnt sand from the combustion zone to the incoming air.

13. The apparatus defined in claim 11 wherein the apparatus further comprises distributor means for distributing flue gases from the combustion zone to the pyrolysis zone, the flue gases accommodating the formation of a fluidized bed in the pyrolysis zone.

14. The apparatus defined in claim 10 wherein the delivery means comprises outlet means below the pyrolysis zone, the outlet means accommodating gravity-assisted delivery of coked sand from the pyrolysis zone to the combustion zone.

15. The apparatus defined in claim 14 wherein the outlet means comprises an elongated pipe having a valve means on lower end of the pipe, the length of the pipe being filled with coked sand thereby inhibiting flue gases from the combustion zone from entering the pyrolysis zone through the outlet means.

16. A process for recovering bitumen products from bitumen-bearing tar sands comprising:

introducing a comminuted tar sand into a first fluidized bed reactor, the first fluidized bed reactor pyrolyzing the bitumen to volatilize the same while leaving a coked sand comprising coke residue on the sand particles from the tar sand;

directing the coked sand from the first fluidized bed reactor into a second fluidized bed reactor, the second fluidized bed reactor combusting the coke to produce thermal energy and a flue gas along with a burnt sand comprising sand particles which are substantially free of coke residue, the flue gas being particularly characterized by the substantial lack of oxygen therein;

fluidizing the second fluidized bed reactor with combustion air having oxygen therein, the oxygen supporting combustion of the coke in the second fluidized bed reactor;

fluidizing the first fluidized bed reactor with said flue gases from the second fluidized bed reactor; and transferring said thermal energy, other than that portion of the energy that is contained in the flue gases, from the second fluidized bed reactor to the first fluidized bed reactor by embedding a first end of a heat pipe means in the second fluidized bed reactor and a second end of a heat pipe means in the first fluidized bed reactor, the heat pipe means transferring a substantial portion of said thermal energy from the second fluidized bed reactor to the first fluidized bed reactor, said thermal energy pyrolyzing said bitumen.

17. The process defined in claim 16 wherein said directing step further comprises placing the first fluidized bed reactor above the second fluidized bed reactor, the physical orientation of the first fluidized bed reactor accommodating feeding coked sand by gravity from the first fluidized bed reactor to the second fluidized bed reactor.

18. The process defined in claim 17 wherein the placing step further comprises inhibiting fines carryover from each of the first and second fluidized bed reactors by segregating a vessel into said first and said second fluidized bed reactors and forming diametrally enlarged sections in the vessel above each of said first and said second fluidized bed reactors, said diametrally enlarged sections lowering upward gaseous velocity thereby allowing fines to settle from upwardly flowing gases.

19. A single-pass process for producing synthetic cruce oil from tar sand comprising:

vertically orienting an enclosed vessel;

segregating the vessel into an upper, pyrolysis zone and a lower, combustion zone;

introducing a comminuted tar sand into the pyrolysis zone thereby producing vapors of synthetic crude oil and a coked sand comprising a coke residue on particles of sand from the tar sand;

feeding coked sand downwardly under the force of gravity from the pyrolysis zone to the combustion zone;

generating thermal energy in the combustion zone by burning the coke residue on the coked sand while producing flue gases and burnt sand;

removing burnt sand downwardly from the combustion zone under the force of gravity;

injecting combustion air into the vessel below the combustion zone, the combustion air absorbing thermal energy from the burnt sand and fluidizing at least a portion of the coked sand in the combustion zone while supporting combustion of the coke residue, the combustion air becoming flue gases in combination with gaseous combustion products from the combustion zone;

fluidizing at least a portion of the comminuted tar sand in the pyrolysis zone with the flue gases from the combustion zone, the flue gases commingling with and carrying away the vapors of synthetic crude oil from the pyrolysis zone;

removing the commingled flue gases and vapors of synthetic crude oil from the upper end of the vessel;

withdrawing the burnt sand from the lower end of the vessel; and transferring a substantial portion of the thermal energy not contained in the flue gases but generated in the combustion zone from the combustion zone to the pyrolysis zone by embedding a first end of a heat pipe means in the combustion zone and a second end of the heat pipe means in the pyrolysis zone, the thermal energy pyrolyzing the tar sand thereby producing vapors of synthetic crude oil.

* * * * *